US006058772A

United States Patent [19]

Aalto

[11] Patent Number: 6,058,772

[45] Date of Patent: May 9, 2000

[54] SAMPLING DEVICE

[75] Inventor: Esa Aalto, Rauma, Finland

[73] Assignee: Posiva Oy, Helsinki, Finland

[21] Appl. No.: 09/068,070

[22] PCT Filed: Sep. 3, 1996

[86] PCT No.: PCT/FI96/00467

§ 371 Date: May 1, 1998

§ 102(e) Date: May 1, 1998

[87] PCT Pub. No.: WO98/10168

PCT Pub. Date: Mar. 12, 1998

[51] Int. Cl.[7] ..... G01N 1/00

[52] U.S. Cl. ..... 73/152.24

[58] Field of Search ..... 73/864.35, 864.51, 73/864.62, 864.73, 864.74, 152.24, 152, 26; 166/264

[56] References Cited

U.S. PATENT DOCUMENTS

| | | | |
|---|---|---|---|
| 3,115,775 | 12/1963 | Russell . | |
| 3,892,130 | 7/1975 | Winget et al. | 73/864.62 |
| 4,295,801 | 10/1981 | Bennett | 73/864.73 |
| 4,727,936 | 3/1988 | Mioduszewski et al. | 73/864.34 |
| 5,095,745 | 3/1992 | Desbrandes | 73/152.24 |
| 5,454,275 | 10/1995 | Kabis . | |
| 5,799,733 | 9/1998 | Ringgenberg et al. . | |

FOREIGN PATENT DOCUMENTS

| | | |
|---|---|---|
| 92/05338 | 4/1992 | WIPO . |

*Primary Examiner*—Robert Raevis
*Attorney, Agent, or Firm*—Andrus, Sceales, Starke & Sawall

[57] ABSTRACT

The invention relates to a sampling device for taking a water sample under pressure from a large depth in a hole bored in the earth. The sampling device comprises parting elements (1) for separating a sampling interval (2) from the rest of the bore hole (3); a flow pipe (4) for extracting the water from the sampling interval; a sample container (5); a sampling pipe (6) for passing up the water supplied by the flow pipe to a point above the sampling device; a valve (7) for directing the water flow directly from the flow pipe into the sampling pipe or from the flow pipe via the sample container into the sampling pipe and for closing and opening the sample container; and a pressure pipe (8) for supplying an operating pressure to the parting element (1) and

15 Claims, 3 Drawing Sheets

SAMPLING DEVICE

BACKGROUND OF THE INVENTION

The present invention relates to a sampling device for taking a water sample under pressure deep in a bore hole made in the earth.

Especially in investigations to determine the suitability of bed rock as a final place of storage for nuclear waste, it is necessary to obtain accurate information about the conditions prevailing inside the rock. Such information is obtained via hydrochemical analysis of water obtained from a hole bored in the rock.

In such cases, the holes are usually at least several hundreds of meters deep and the conditions deep in the hole are completely different from those on the ground surface. Therefore, a water sample pumped up from the hole to the ground surface no longer corresponds to a water sample deep in the hole, but, especially due to the pressure difference, the gases dissolved in the water under a high pressure are largely separated from the aqueous phase at normal air pressure.

In prior art, in an attempt to eliminate these problems, use has been made of a container in which a vacuum is created while on the ground. The container is then lowered deep into the hole, where it is filled through a valve. The container keeps the water sample at the pressure prevailing at the sampling depth, so the liquid can be studied in this pressurized state. However, this structure involves significant problems. When the container previously exhausted on the ground is filled, the water pressure falls radically and the dissolved gases may be separated from the aqueous phase. Maintaining the pressure while the container is being hoisted up is a further problem.

The object of investigation is natural water present in chinks in the rock, but the water obtained from a hole hardly ever represents it accurately. Even from rock chinks, a sample close to the natural condition can only be obtained after prolonged pumping.

Further problems in performing the measurements are also caused by the relatively small hole diameter of Ø56 mm generally used in these investigations. Such holes cannot accommodate very complicated equipment.

SUMMARY OF THE INVENTION

The object of the invention is to eliminate the problems described above. A specific object of the invention is to present a new type of sampling device which enables a water sample taken from a deep hole to be accurately preserved in its original state corresponding to the actual conditions prevailing deep in the earth under a high pressure.

As for the features characteristic of the invention, reference is made to the claims.

The sampling device of the invention comprises parting elements, by means of which a sampling interval is separated from the rest of a bore hole, preventing free flow of water between the sampling interval and the rest of the hole. Moreover, the sampling device comprises at least one sample container, a flow pipe for extracting the water from the sampling interval, a sampling pipe for passing up the water supplied via the flow pipe, and a valve which can be used to direct the flow of the water alternatively directly from the flow pipe into the sampling pipe or from the flow pipe via the sample container into the sampling pipe and which also pressure-tightly closes and opens the sample container. Furthermore, the sampling device comprises a pressure pipe through which an operating pressure is supplied from the ground surface both to the parting element and to the valve.

The sampling device of the invention preferably comprises a limit pressure valve which allows direct flow of water from the flow pipe into the sampling pipe when the valve is closed but prevents direct flow from the flow pipe into the sampling pipe when the valve is open, so that the water flows from the flow pipe via the sample container into the sampling pipe.

The parting elements and the valve are preferably arranged to be operated via a common pressure pipe. In this case, the valve is provided with a counter-element, which may be e.g. a spring, which acts against the movement of the controlling element of the valve produced by the pressure in the pressure pipe. Thus, preferably two overpressure levels are used in the pressure pipe, the parting elements being actuated at the first overpressure level, separating the sampling interval from the rest of the hole while the sample container remains closed, whereas at the second overpressure level the valve is arranged to open a flow path into the sample container, blocking the direct flow path up the sampling pipe, and to direct the water flow from the flow pipe via the sample container into the sampling pipe.

The sample container is preferably an elongated and cylindrical structure containing an intermediate piston, which substantially pressure-tightly separates a sample space and a counterpressure space in the sample container.

The lower end of the sample container, i.e. the counterpressure space, is provided with a valve through which a suitable counterpressure can be created in the counterpressure space using an inert gas, such as argon, helium or nitrogen. The counterpressure can be suitably changed as required so that a desired amount of sample water is always obtained in the sample space, depending on the depth of the sampling hole, i.e. on the pressure prevailing in the hole.

Preferably both the inlet duct and the outlet duct of the sample container are placed at the upper end of the sample container to prevent the accumulation of gas in the sample container. In addition, the upper end of the sample container is provided with e.g. manually operated inlet and outlet valves permitting the container to be tightly closed when necessary, e.g. after the sample container has been lifted up from the hole.

The inlet duct of the sample container is preferably provided with a nozzle after the inlet valve to suitably direct the sample water, e.g. in turbulent flow, into the sample container, so that the sample water is effectively mixed and evenly exchanged in the sample container.

The sampling device of the invention preferably comprises at least two sample containers placed one above the other or successively in the hole. In this case the containers are preferably arranged in series so that the water flows from the sampling interval via the flow pipe through each sample container in succession into the sampling pipe.

In an embodiment of the invention, the sampling pipe leading upward from the sampling device extends through the hole up to the ground surface. This allows the flow of water into the sampling interval to be monitored and the water quality to be examined, enabling a sample to be taken at an exactly suitable moment, i.e. when a balanced state regarding changes in water properties has been reached.

In another embodiment of the invention, no sampling pipe extending through the hole to the ground surface is used at all, but the water is allowed to flow directly from the sampling interval or sample container through a valve into the hole. In this case, the water flowing up through the bore hole can be monitored and a sample can be taken after a suitable length of time. On the other hand, the sampling can be performed based on empirical knowledge, which means that a sample is taken after the lapse of a sufficient period of time or after a sufficient amount of water has flowed out from the pipe. Likewise, in this case the sample containers can be kept open for a suitable length of time based on empirical knowledge. Thus, the whole device becomes very simple as it can be lowered into the hole supported only by the pressure pipe and no other connections to the sampling device deep in the hole are required.

The sampling device of the invention provides significant improvements to the current technology for taking samples from deep holes. By means of the device, it is possible to precisely delimit the hole portion from which a sample is to be taken, so that other parts of the hole will not cause any inaccuracy in the measurement. With the device, the measuring conditions can be allowed to become as stable as possible before actual sampling and the sample is received for above-ground investigation in a pressurized state corresponding to the real conditions. In addition, the sampling device is very simple in structure and use because it has only one or two pipes going up to the ground surface, a sampling pipe and a pressure pipe. Thus, it can be easily constructed in a form with a small diameter and fitted into bore holes, which generally have a diameter of only 56 mm.

BRIEF DESCRIPTION OF THE SEVERAL VIEWS OF THE DRAWING

In the following, the invention is described in detail by referring to the attached drawings, in which.

DETAILED DESCRIPTION OF THE INVENTION

Figure 1:
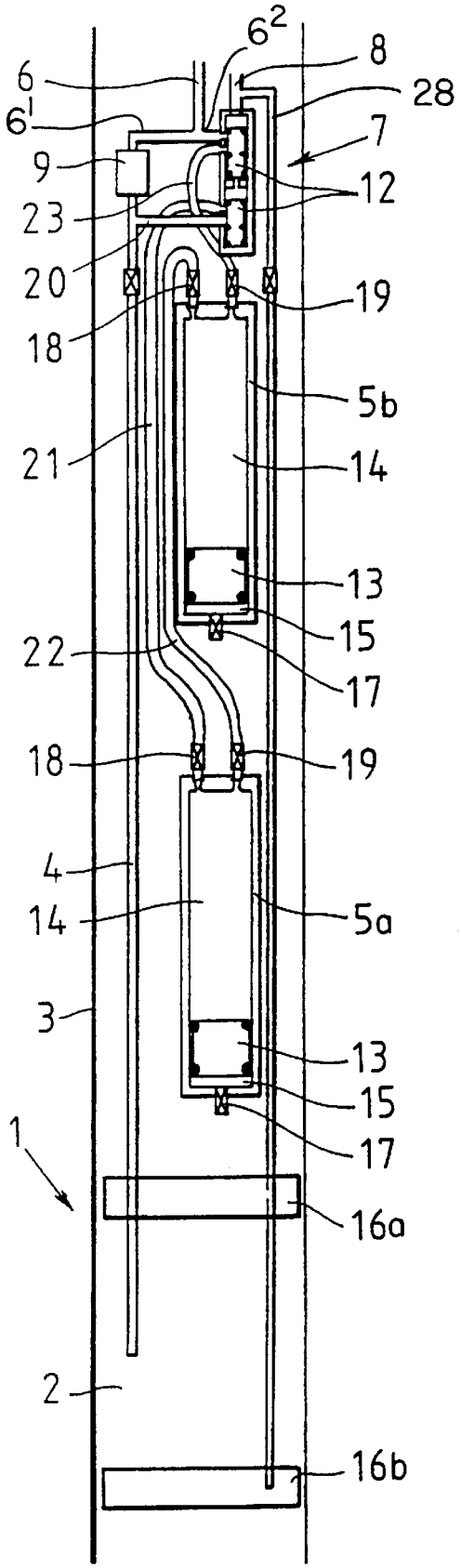
FIG. 1 presents a diagram representing a sampling device as provided by the invention.

FIG. 1 shows a deep bore hole 3 made in the rock, with a depth of e.g. several hundred meters. Placed in the bore hole is a sampling device according to the invention, provided with parting elements 1. These consist of two plugs 16*a*, 16*b* placed at a distance from each other. Using pressure supplied via a pressure pipe 8, the plugs 16*a*, 16*b* can be pressed tightly against the interior surface of the hole 3, forming between them a sampling interval 2 with no flow connection to the hole portions above and below it.

Above the sampling interval, the sampling device has two sample containers 5*a*, 5*b* and above them a valve 7 and a limit pressure valve 9, which are connected to each other as follows. From the sampling interval 2, a flow pipe 4 goes up past the sample containers to the limit pressure valve 9, through which the water can flow in a sampling pipe 6 up to the ground surface. Before the limit pressure valve, the flow pipe 4 branches out via a branch pipe 20 to the valve 7. From the valve 7, a first connecting pipe 21 leads to the inlet connection of the lower sample container 5*a*. From the outlet connection of the lower sample container, a second connecting pipe 22 leads to the inlet connection of the upper sample container 5*b*, and the outlet connection of the upper sample container is connected via a third connecting pipe 23 to the valve 7. When the valve 7 is open, the third connecting pipe 23 leads through the valve to the sampling pipe 6. Moreover, a pressure pipe 8 leads from above ground to the valve 7 to allow it to be operated and in addition to the plugs 16*a*, 16*b* of the parting elements 1.

Each sample container 5*a*, 5*b* contains an intermediate piston 13 which pressure-tightly separates from each other a sample space 14 and a counterpressure space 15 inside the sample container. The bottom of the counterpressure space, i.e. the bottom of the sample container itself, is provided with a valve 17 to allow the counterpressure space to be filled with a suitable gas.

The device depicted in FIG. 1 is used as follows. When a water sample is to be obtained from a given distance in the hole 3, the sampling device is lowered into the hole so that the desired portion of the hole is enclosed between the plugs 16*a*, 16*b*. The distance between the plugs is preferably adjustable. After this, a suitable pressure, e.g. about 3 bar, is supplied into the pressure pipe 8 to press the plugs pressure-tightly against the surface of the hole so that water currents flowing within the sampling interval from the rock into the hole cannot get past the plugs to the rest of the hole.

After the plugs 16*a*, 16*b* have been pressed in position, the water entering into the sampling interval 2 can flow up through the flow pipe 4 and, as the valve 7 is still closed, the limit pressure valve 9, which works at a pressure of e.g. 0.5 bar, lets the water flow through it into the sampling pipe 6. The water flowing up from the sampling pipe to the ground surface can be monitored and analyzed. It is only after the water flow in the sampling pipe has been balanced, i.e. when no substantial changes are observed in its composition, that actual sampling is started. Sufficient balancing generally takes weeks, even months.

When an actual water sample is to be taken, the pressure in the pressure pipe 8 is raised, causing the plugs 16*a*, 16*b* to be further pressed in place and in addition the valve 7 to be actuated at a pressure of e.g. about 9 bar. At this time, the controlling element 12 of the valve moves from the condition shown in FIG. 2 to the condition shown in FIG. 3, creating a direct connection from the branch pipe 20 to the first connecting pipe 21 and likewise a direct connection from the third connecting pipe 23 to the sampling pipe 6. Now, when the pressure difference is evened out on both sides of the limit pressure valve 9, the latter is closed and the liquid flow from the sampling interval via the flow pipe 4 and conduit 4*a* passes from the branch pipe 20 through valve 7 into the first connecting pipe 21 and further into the lower sample container and from there further via the second connecting pipe 22 into the upper sample container and further via the third connecting pipe 23 and valve 7 into the sampling pipe 6. When valve 7 is actuated, the intermediate pistons 13 are pressed downward and the counterpressure spaces 15 function as a necessary gas buffer, because without it even small changes in the container volume would produce a large change in the pressure of the water sample.

When the water from the sampling interval has started to flow via the sample containers into the sampling pipe 6, analysis of the water coming up from the sampling pipe 6 is continued on the ground surface. When the sample water obtained on the ground is equal in quality and substantially unchanged in respect of its properties, it can be assumed that the conditions deep in the hole have also become stable. In this situation, the pressure in the pressure pipe 8 is dropped to the level of about 3 bar and valve 7 closes the sample containers pressure-tightly. The pressure is then reduced further, causing the plugs 16*a*, 16*b* to be released from their engagement with the hole surface and thus enabling the whole device to be extracted from the hole. On the ground surface, valves 18 and 19 of both sample containers are closed, whereupon the containers can be released and transported to an appropriate place for investigation.

Figure 2:
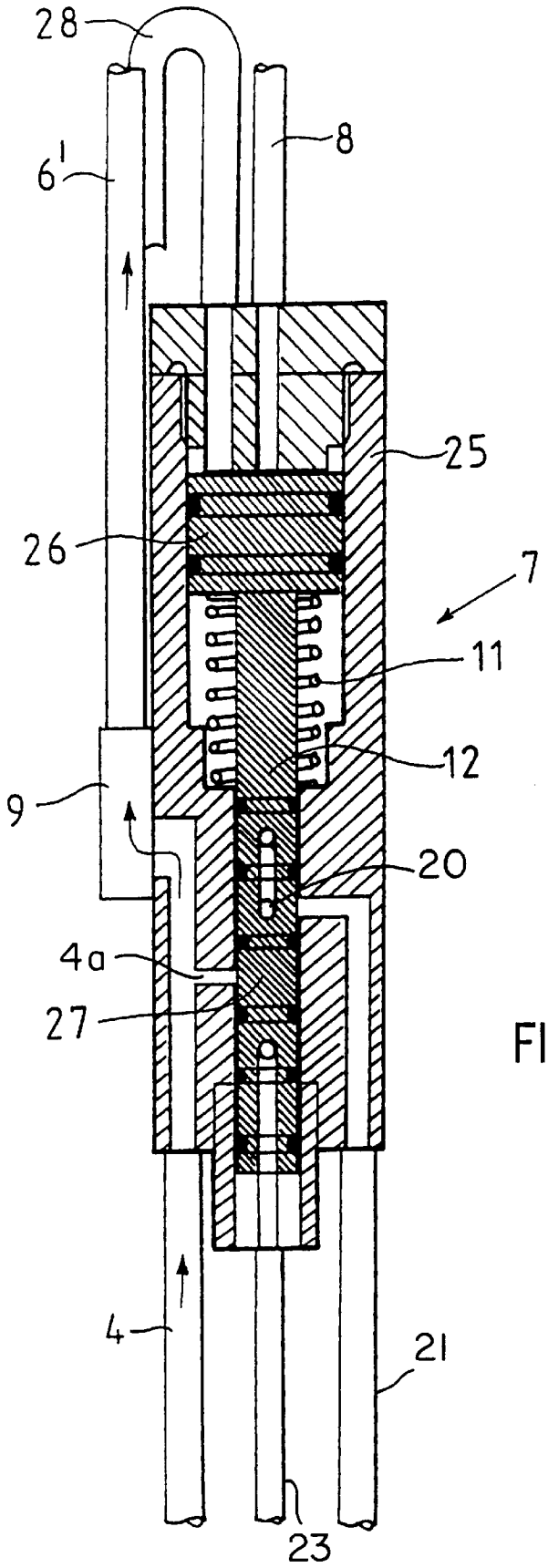
FIG. 2 presents a diagrammatic sectional view of a valve as used in the sampling device of the invention in its closed state.
Figure 3:
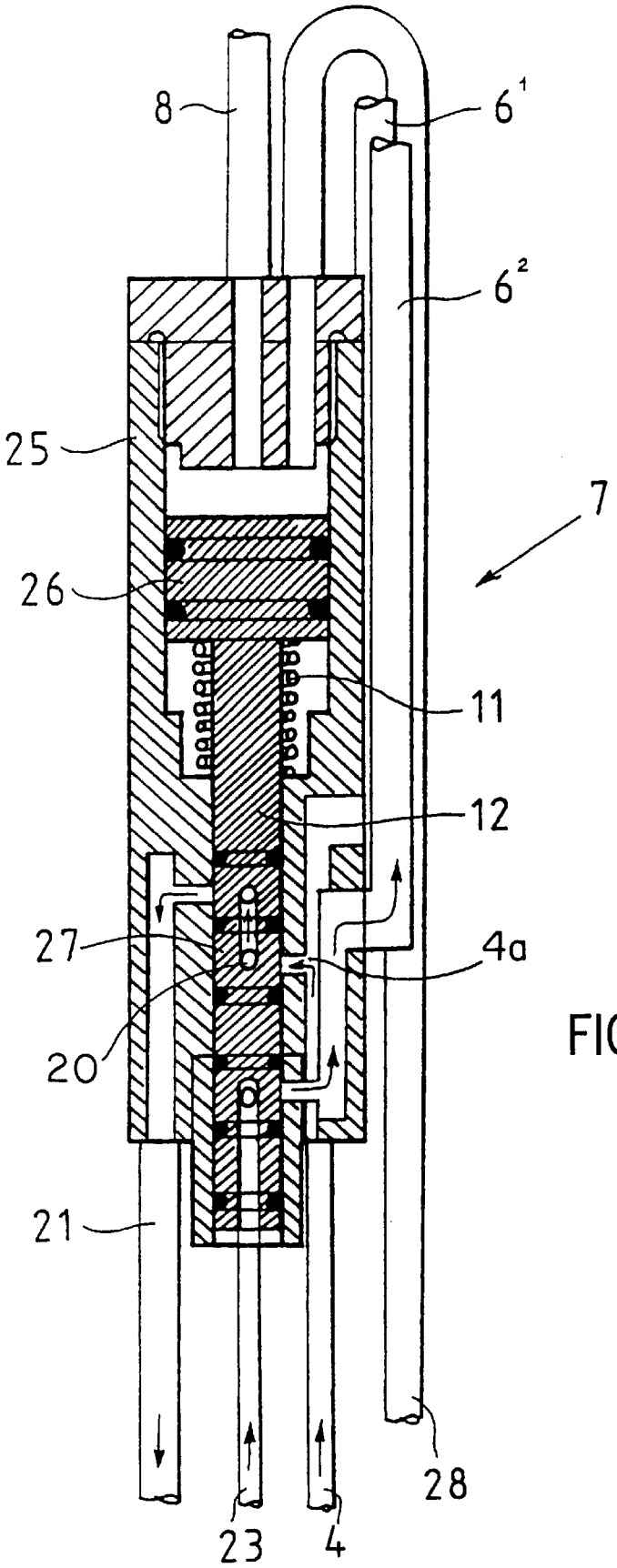
FIG. 3 presents the valve of FIG. 2 in the open state and as seen from the opposite direction.

FIGS. 2 and 3 present a more detailed view of a valve 7 which can be used in the sampling device of the invention.

Inside the body 25 of the valve there is a piston-like controlling element 12, which has a wider O-ring piston 26, whose end is exposed to the pressure of the pressure pipe 8. Below this wider part is a piston rod 27, which acts as a valve part. In addition, around the piston rod there is a spring 11 acting as a counter-element, pressing the O-ring piston 26 upwards against the pressure of the pressure pipe 8.

In the situation depicted in FIG. 2, there is no pressure in the pressure pipe 8 or the pressure is relatively low, so that it cannot overcome the pressure of the counter-element 11. In this situation, a channel can exist at the top of the O-ring piston 26 so that a pressure can still be applied from the pressure pipe 8 through pipe 28 to the plugs 16*a*, 16*b* of the parting element. The valve part 27 is now closed and the liquid from the flow pipe 4 can only flow to the sampling pipe 6 via the limit pressure valve 9.

As illustrated by FIG. 3, when the pressure in the pressure pipe 8 is increased, the controlling element 12 of the valve is pushed downwards, causing a path to be opened from the flow pipe 4 into the first connecting pipe 21, which leads to the first sample container. E.g. the third connecting pipe 23 coming from the last sample container is opened via the valve into the sampling pipe 6, bringing the water sample to the ground surface.

In FIG. 3, for the sake of clarity, the flow passing via the sample containers is directed into sampling pipe $\mathbf{6}^2$, and sampling pipe $\mathbf{6}^1$ represents the flow path closed by the limit pressure valve. In practice, the flow paths join as soon as possible into a common flow channel.

In the foregoing, the invention has been described by way of example by the aid of the attached drawings while different embodiments of the invention are possible within the inventive idea defined by the claims.

I claim:

1. A sampling device suitable for being lowered into a deep hole bored in the earth for obtaining a subterranean water sample from a large depth in the hole, said sampling device comprising:

spaced parting elements (1) positionable along the bore hole (3) and operable to define a sampling interval (2) between the parting elements in the bore hole and to separate the sampling interval from the remainder of the bore hole;

a flow pipe (4) for extracting water from the sampling interval;

a sampling container (5);

a sampling pipe (6) for passing up water supplied by the flow pipe to a point above the sampling device;

a valve (7) coupled to said flow pipe, sampling container, and sampling pipe, said valve having a first condition for sealing said sampling container and in which condition the water from said flow pipe is directed to said sampling pipe, said valve having a second condition for opening said sampling container and directing water from said flow pipe through said sampling container to said sampling pipe; and a pressure pipe for supplying an operating pressure to said parting elements and to said valve for operating said valve between said first and second conditions.

2. Sampling device as defined in claim 1 characterized in that said valve (7) has a controlling element (12) movable responsive to the operating pressure supplied by said pressure pipe to alter the condition of said valve, and wherein said valve includes a biasing means opposing movement of said controlling element responsive to the operating pressure.

3. Sampling device as defined in claim 1, characterized in that the sampling device includes a limit pressure valve (9) coupled to said flow pipe and said sampling pipe which passes the water flow directly from the flow pipe (4) into the sampling pipe (6) when the valve (7) is in the first condition.

4. Sampling device as defined in claim 1, characterized in that the parting elements (1) and the valve (7) are arranged to be operated by a common pressure and are connected to a common pressure pipe.

5. Sampling device as defined in claim 4 wherein in said pressure pipe supplies a lower operating pressure and a higher operating pressure, wherein said parting elements are operable at said lower operating pressure to define the sampling interval, and wherein said valve is operable to said second condition by said higher operating pressure.

6. Sampling device as defined in claim 1, characterized in that the sample container (5) is provided with an intermediate piston (13) which separates a sample space (14) and a counterpressure space (15) in the sample container.

7. Sampling device as defined in claim 6 wherein said counterpressure space (15) contains a pressurizing gas for generating a counterpressure.

8. Sampling device as defined in claim 7 wherein said sampling container has first and second ends, said first end of said sampling container being coupled to said valve, said second end of said container having a valve for supplying said pressurizing gas to said counterpressure space.

9. Sampling device as defined in claim 1, characterized in that an end of the sample container (5) is provided with an inlet valve (18) and an outlet valve (19), through which the sample water flows into and out of the sample container.

10. Sampling device as defined in claim 9 wherein said end of said sampling container comprises an upper end when said container is oriented for use.

11. Sampling device as defined in claim 9, characterized in that it has a nozzle after the inlet valve (18) to generate a turbulent and mixing movement in the sample water flowing into the sample container.

12. Sampling device as defined in claim 1, characterized in that the sampling device comprises at least two sample containers arranged in series so that the water flows from the sampling interval (2) via the flow pipe (4) through each sample container in succession into the sampling pipe (6).

13. Sampling device as defined in claim 1, characterized in that the parting elements (1) comprise two plugs (16*a*, 16*b*) placed at a distance from each other and pressed against the interior surface of the hole (3) by the pressure of the pressure pipe (8).

14. Sampling device as defined in claim 1, characterized in that the sampling pipe (6) leads through the hole (3) to the ground surface to pass the water up from the hole.

15. Sampling device as defined in claim 1 wherein said sampling pipe is coupled to said flow pipe downstream of said valve.

* * * * *